United States Patent [19]

Schneider

[11] Patent Number: 4,846,243

[45] Date of Patent: Jul. 11, 1989

[54] FOLDABLE WINDOW COVERING

[75] Inventor: Paul A. Schneider, Madison, Wis.

[73] Assignee: Graber Industries, Inc., Middleton, Wis.

[21] Appl. No.: 233,729

[22] Filed: Aug. 19, 1988

[51] Int. Cl.[4] ..... E06B 3/94

[52] U.S. Cl. ..... 160/84.1; 160/230; 160/348

[58] Field of Search ..... 160/84.1, 279, 230, 160/123, 348

[56] References Cited

U.S. PATENT DOCUMENTS

| | | | |
|---|---|---|---|
| 1,752,610 | 4/1930 | McSpadden | 160/84.1 |
| 1,937,342 | 11/1933 | Higbie | 160/84.1 X |
| 2,305,559 | 12/1942 | Roy | 160/34 |
| 3,055,419 | 9/1962 | Rubin et al. | 160/84.1 |
| 3,181,597 | 5/1965 | Levine | 160/348 |
| 3,259,151 | 7/1966 | Schmitz | 160/84.1 X |
| 3,777,800 | 12/1973 | Susoev | 160/84.1 |
| 4,069,857 | 1/1978 | Brookshire | 160/84.1 |
| 4,347,887 | 9/1982 | Brown | 160/368.1 |
| 4,375,232 | 3/1983 | Heescher et al. | 160/84.1 |
| 4,535,828 | 8/1985 | Brockhaus | 160/84.1 |
| 4,677,013 | 6/1987 | Anderson | 160/84.1 X |

FOREIGN PATENT DOCUMENTS

| | | | |
|---|---|---|---|
| 62564 | 8/1944 | Denmark | 160/84.1 |
| 897003 | 11/1953 | Fed. Rep. of Germany | 160/84.1 |
| 370176 | 4/1932 | United Kingdom | 160/84.1 |

*Primary Examiner*—Ramon S. Britts
*Assistant Examiner*—David G. Kolman
*Attorney, Agent, or Firm*—Vernon J. Pillote

[57] ABSTRACT

A foldable window covering formed of a single web of flexible material. The web is formed with a plurality of independent loops extending from one side with opposed faces of the loops connected together along a horizontal seam parallel to and spaced from the end of the loop to form a pocket in each loop. The seams of adjacent loops are spaced apart such that the web forms a curtain wall section between adjacent loops which limits the spacing between adjacent loops when the window covering is in the expanded condition, and the loops are adapted to hang down and have a length such that each loop overlaps a subjacant loop when the window covering is in the expanded condition.

9 Claims, 2 Drawing Sheets

FOLDABLE WINDOW COVERING

BACKGROUND OF THE INVENTION

Various different foldable window coverings have heretofore been made from a single web of material. In the so-called "Roman Shades" such as disclosed in U.S. Pat. Nos. 1,752,610 and 4,069,857, a single web is folded to form relatively stiff horizontally extending ribs at one side of the shade and the lift cords extend through openings in the ribs. With such shades, the ribs are spaced apart and the lift cords are exposed to view from one side of the shade, when the shade is in an expanded condition. In U.S. Pat. No. 2,305,559, a single web of material is folded to form a series of inverted V-shaped louvers. U.S. Pat. No. 3,055,419 discloses a window shade in which a single web is folded to form box pleats alternately at opposite sides of the panel. In U.S. Pat. No. 4,347,887, a single web of material is reversibly folded in zig zag fashion and bonded to itself at spaced intervals to form a plurality of cells arranged in a double row configuration.

SUMMARY OF THE INVENTION

Various objects of the present invention are to provide a decorative window covering formed from a single web of fabric and which is expandable and contractable for use as a movable window shade; which has distinctly different front and back appearance when in an expanded condition; which conceals the lift cords when the window covering is in an expanded condition, which has good thermal insulation characteristics, and which can be economically formed and fabricated into custom width and length window shades.

Accordingly, the present invention provides a foldable window covering formed of a single web of flexible material, the window covering having a top and a bottom movable relative to each other between a folded and an expanded condition. The web has a plurality of independent loops extending from one side only with opposed faces of each loop connected together along a horizontal seam parallel to and spaced from the distal end of the loop. The seams of adjacent loops are vertically spaced apart along the web such that the web forms a curtain wall section between adjacent loops which limits the spacing between adjacent loops when the window covering is in an expanded condition, and the loops are adapted to hang downwardly and have a length such that each loop overlaps a subjacent loop when the window covering is in the expanded condition. A vertical row of openings extends through the loops adjacent the curtain wall sections and lift cords extend through the row of openings for moving the top and bottom of the window covering relative to each other.

The loops define a first vertical row of horizontal pockets inside the loops and a second vertical row of horizontal pockets between the loops and the curtain wall sections, when the window covering is in the expanded condition. The curtain wall sections are advantageously provided with a horizontally extending crease intermediate adjacent loops to facilitate folding of the curtain wall sections to the folded condition of the window covering.

DETAILED DESCRIPTION

The foldable window covering is formed of a single web of material. The web of fabric can be a woven, non-woven, knit or stitch bonded fabric and can be formed from synthetic or natural fibers or a blend of synthetic and natural fibers. Further, the web of material from which the window covering is formed, can have a different color or texture at opposite sides. For example, the web of material could be a decorative woven pattern on the one side with a solid neutral or white surface on the other side. Further, one side such as the back side of the fabric could be vacuum metalized, laminated or knife coated to create a neutral exterior appearance.

Figure 2:
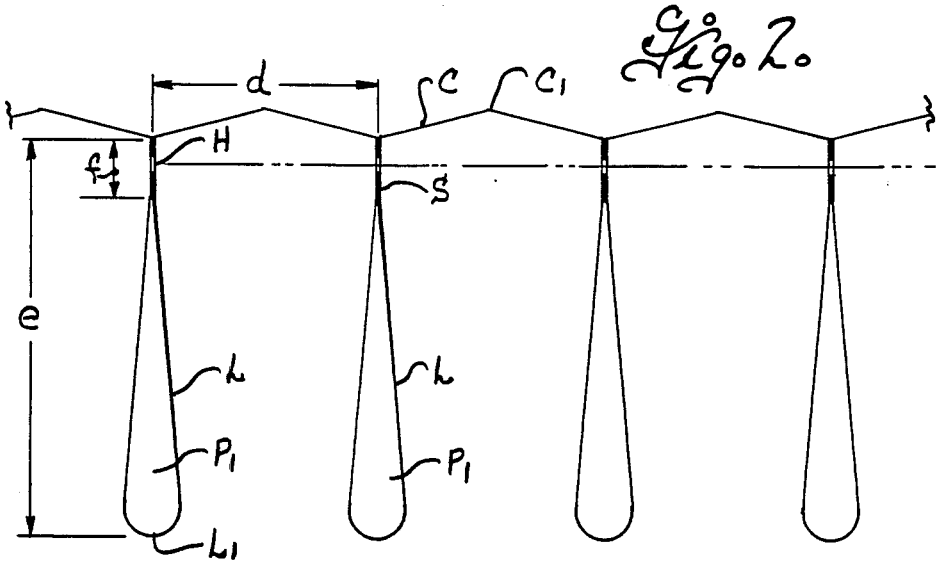
FIG. 2 is a diagrammatic view illustrating the folding, seaming and creasing of the window covering.
Figure 3:
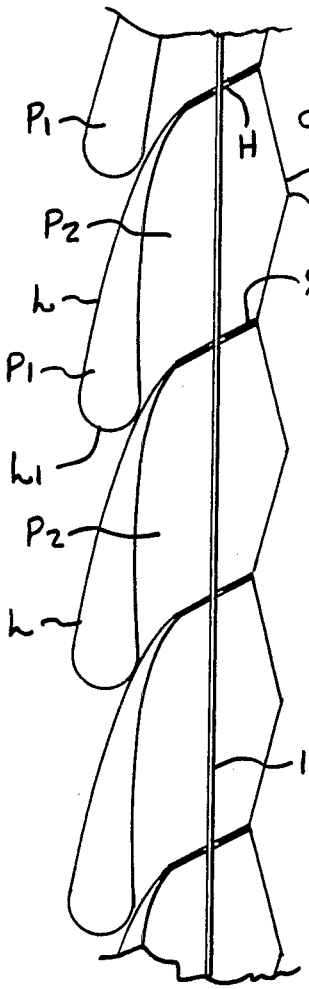
FIG. 3 is a fragmentary vertical sectional view illustrating the window covering in an expanded condition.

The web is formed into a plurality of independent loops L that extend from one side only of the web, and opposed faces of each loop are connected together along a horizontal seam S that extends parallel to and is spaced from the distal end $L_1$ of the loop. The seams of adjacent loops are spaced apart a preselected distance along the web such that the web forms a curtain wall section C between adjacent loops, which curtain wall section limits the spacing between adjacent loops when the window covering is in the expanded condition. The loops L formed in the flexible web are adapted to hang downwardly and have a length such that each loop overlaps a subjacent loop when the window covering is in the expanded condition, as shown in FIG. 3. More specifically, the curtain wall sections C limit the spacing between adjacent loops to a preselected distance designated d in FIG. 2 when the window covering is in the expanded condition and the curtain wall sections are substantially straight. The loop extension, measured from the curtain wall section to the distal end of the loop, and designated e in FIG. 2, is made greater than the distance d, so that the loops hang down and overlap a subjacent loop when the window covering is in the expanded condition. The seam S is spaced from the distal end $L_1$ of the loop to form a pocket $P_1$ in each loop. Thus, when the curtain is in an expanded condition, the loops L form a first vertical row of horizontal pockets $P_1$ inside the loop, and a second vertical row of pockets $P_2$ between the loops and the curtain wall sections. The dual rows of pockets $P_1$ and $P_2$ enhances the thermal insulation characteristics of the window covering, when it is in an expanded condition.

Vertical rows of openings H are formed in the loops L adjacent the curtain wall sections C, for receiving lift cords 10. The holes are advantageously formed in the seams S and, for this purpose, the seams are formed with an effective width designated f in FIG. 2, which is substantially greater than the cross sectional size of the holes H. The seams can be formed in any desired manner, for example by ultrasonic welding when the web is formed of synthetic fibers or a blend of synthetic and natural fibers, or by heat sealing if the web is formed of a thermoplastic material. The seam can also be formed by use of adhesives or by sewing. As will be readily understood, the seam does not have to be bonded across the entire width F, but can instead be formed by spaced rows or by a pattern of sealing or stitching which joins the faces of the loop together along the width F. The holes H can conveniently be formed in the loops by punching or otherwise at the time the loops are joined together along the seam S. The holes are preferably formed at a plurality of equally spaced locations along the seam, to facilitate fabrication of window shades of different width, with a minimum of scrap.

Figure 4:
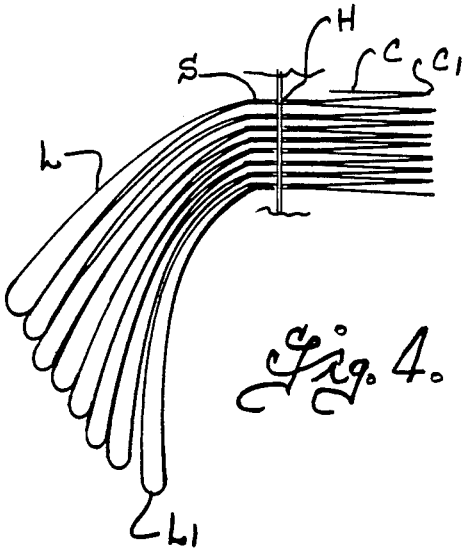
FIG. 4 is a fragmentary sectional view illustrating the window covering in a folded or collapsed condition.

The curtain wall sections C are advantageously formed with a crease designated $C_1$ medially between the adjacent loops L, and oriented with the apex of the crease at the rear side of the web, to facilitate out folding of the curtain wall sections when the window covering is moved to its collapsed condition as shown in FIG. 4.

Figure 1:
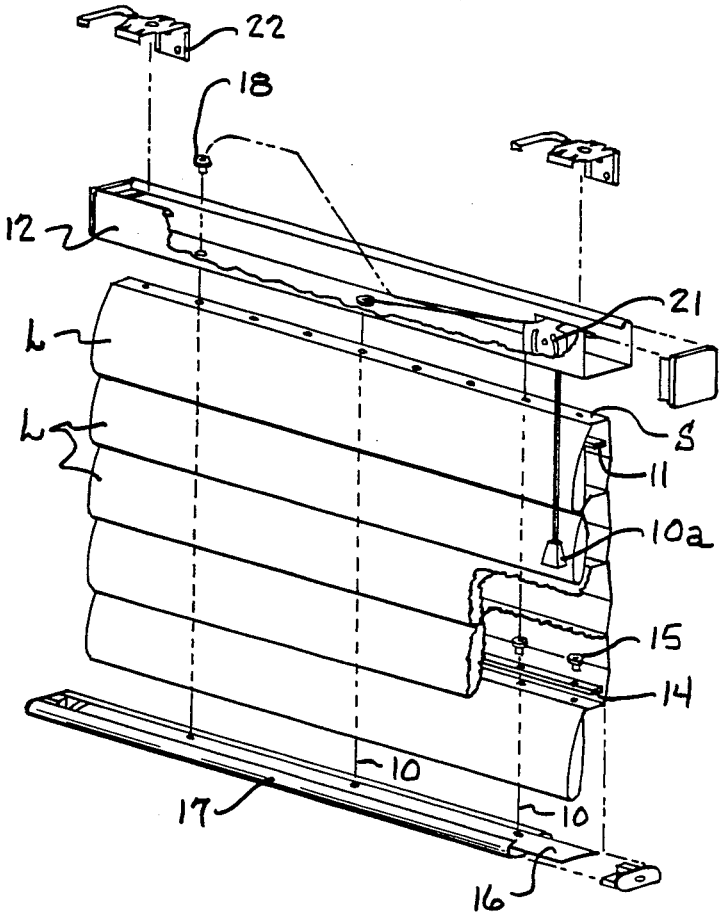
FIG. 1 is an exploded perspective view of a foldable window covering embodying the present invention, with parts broken away to illustrate details of construction.

A window shade fabricated of the foldable window covering material is shown in FIG. 1. The seam portion S of the loop L at the upper end of the foldable window covering is secured, as by a slat 11 and suitable fasteners (not shown) to a headrail 12. The seam portion S of the lower loop is attached as by a slat 14 and fasteners 15 to a bottom rail insert 16 that is adapted for mounting on a bottom rail 17. The lift cords 10 are attached at their lower ends to the bottom rail, and extend upwardly through selected rows of the openings H in the loops L and through guides 18 in the headrail and then lengthwise of the headrail and over a cord guide and lock assembly 21 and terminate in a lift cord tassel lO*a*. The headrail is adapted to be mounted by conventional brackets 22 to a supporting surface such as a window casing, or wall or the like.

From the foregoing it is believed that the construction and operation of the foldable window covering will be readily understood. When the bottom rail is lowered to allow the window covering to move to its expanded condition as shown in FIGS. 1 and 3, the curtain wall sections C move to a generally straight condition so that the back side of the window covering has a plain appearance. The curtain wall sections limit the spacing between adjacent loops when the window covering is in its expanded condition and each loop overlaps a subjacent loops so that the front side of the window covering has the appearance of a softly folded fabric. When in the expanded condition, the loops define a first vertical row of horizontal pockets $P_1$ inside the loops and a second vertical row of horizontal pockets $P_2$ between the loops and the curtain wall sections C. The double row of air pockets reduces thermal transmittance through the window covering. If the window covering is formed of a translucent or an open weave or knit fabric, the loops in the web also reduce light or sight transmission through the window covering. However, the loops remain independently movable so that a person at the inside of the window covering would lift a loop or loops to peer through the curtain wall section, without raising or folding the entire window shade. Since one side of the web is exposed at the inner side of the window covering and the opposite side of the web is exposed at the outer side, the web can be formed of a material with different patterns, coatings or coloring at opposite sides of the web. The lift cords which extend through holes in the loops at the loops, are disposed in front of the curtain wall sections and behind the depending portion of the loops so that the lift cords are concealed from view at both sides of the window covering.

The embodiments of the invention in which an exclusive property or privilege is claimed are defined as follows:

1. A foldable window covering comprising a single web of flexible material, the window covering having a top and a bottom movable relative to each other between a folded and an expanded condition, the web having a plurality of independent loops extending from one side only of the web with opposed faces of each loop connected together along a horizontal seam parallel to and spaced from the distal end of the loop to form a pocket in the loop, the seams of adjacent loops being vertically spaced apart along the web such that the web forms a curtain wall section between adjacent loops which limits the spacing between adjacent loops when the window covering is in the expanded condition, the loops being adapted to hang downwardly and having a length such that each loop overlaps a subjacent loop when the window covering is in the expanded condition, at least one vertical row of openings extending through the loops adjacent the curtain wall sections, and lift cord means extending through said row of openings for moving the top and bottom of the window covering relative to each other, the loops defining a first vertical row of horizontal pockets inside the loops and a second vertical row of horizontal pockets between the loops and the curtain wall sections, when the window covering is in the expanded condition.

2. A foldable window covering according to claim 1 wherein said curtain wall sections have a horizontally extending crease intermediate adjacent loops to facilitate folding of the curtain wall sections to the folded condition of the window covering.

3. A foldable window covering according to claim 1 wherein the vertical row of openings extend through the seams in the loops.

4. A foldable window covering according to claim 3 wherein said curtain wall sections have a horizontally extending crease intermediate adjacent loops to facilitate folding of the curtain wall sections to the folded condition of the window covering.

5. A foldable window covering comprising a single web of flexible material, the window covering having a top and a bottom movable relative to each other between a folded and an expanded condition, the web having a plurality of independent loops extending from one side only of the web with the opposed faces of each loop connected together along a horizontal seam parallel to and spaced from the distal end of the loop to form a pocket in the loop, the seams of adjacent loops being vertically spaced apart a preselected distance along the web such that the web forms a curtain wall section between adjacent loops when the window covering is in the expanded condition, the loop extension, measured from the curtain wall section to the distal end thereof, being greater than said preselected distance, at least one vertical row of openings extending through the loops adjacent the curtain wall sections, and lift cord means extending through said row of openings for moving the top and bottom relative to each other, the loops defining a first vertical row of horizontal pockets inside the loops and a second vertical row of horizontal pockets between the loops and the curtain wall sections, when the window covering is in the expanded condition.

6. A foldable window covering according to claim 5 wherein the vertical row of openings extends through the seams in the loops.

7. A foldable window covering according to claim 5 wherein the curtain wall sections limit spacing of the loops to substantially said preselected distance when the curtain is in the expanded condition.

8. A foldable window covering according to claim 7 wherein the curtain wall sections have a horizontally extending crease intermediate adjacent loop to facilitate folding of the curtain wall sections to the folded condition of the window covering 9. A foldable covering according to claim 8 wherein the vertical row of openings extend through the seams in the loops.

* * * * *

UNITED STATES PATENT AND TRADEMARK OFFICE

CERTIFICATE OF CORRECTION

PATENT NO. : 4,846,243

DATED : July 11, 1989

INVENTOR(S) : Paul A. Schneider, et al

It is certified that error appears in the above-identified patent and that said Letters Patent is hereby corrected as shown below:

On the title page inventor should read

- (75) Inventors: Paul A. Schneider, Madison, and

Joseph E. Cole, Hartland, both of Wis.--.

Signed and Sealed this

Tenth Day of April, 1990

*Attest:*

HARRY F. MANBECK, JR.

*Attesting Officer*

*Commissioner of Patents and Trademarks*